US010946680B2

(12) United States Patent
Nakamura

(10) Patent No.: US 10,946,680 B2
(45) Date of Patent: Mar. 16, 2021

(54) GUIDE DEVICE AND PRINTER

(71) Applicant: Kahei Nakamura, Tokyo (JP)

(72) Inventor: Kahei Nakamura, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/716,005

(22) Filed: Dec. 16, 2019

(65) Prior Publication Data

US 2020/0207129 A1 Jul. 2, 2020

(30) Foreign Application Priority Data

Dec. 28, 2018 (JP) ..... JP2018-248132
May 13, 2019 (JP) ..... JP2019-090538

(51) Int. Cl.
*B41J 25/304* (2006.01)
*B41J 25/308* (2006.01)

(52) U.S. Cl.
CPC ..... *B41J 25/304* (2013.01); *B41J 25/308* (2013.01); *B41J 25/3082* (2013.01); *B41J 25/3086* (2013.01)

(58) Field of Classification Search
CPC ... B41J 2/304; B41J 2/312; B41J 2/001; B41J 2/308; B41J 2/3082; B41J 2/3086; B41J 1/36; B41J 19/00
See application file for complete search history.

(56) References Cited

U.S. PATENT DOCUMENTS

2006/0232623 A1* 10/2006 Murcia et al. ..... B41J 25/308
2010/0328372 A1* 12/2010 Chuang ..... B41J 25/308
2013/0034376 A1 2/2013 Saiga
2013/0271527 A1 10/2013 Shimizu
2014/0063123 A1 3/2014 Saiga et al.
2014/0253652 A1 9/2014 Ohba et al.
2015/0116394 A1* 4/2015 Izuo ..... B41J 25/308
2015/0210091 A1 7/2015 Hoshina et al.
2015/0224802 A1 8/2015 Kawamichi et al.
2015/0346659 A1 12/2015 Nagayama et al.
2016/0121634 A1 5/2016 Saiga et al.
2016/0297212 A1 10/2016 Saiga et al.
2017/0210578 A1 7/2017 Nakada et al.
2017/0210579 A1 7/2017 Watanabe et al.
2018/0147835 A1 5/2018 Nakamura et al.
2018/0311983 A1 11/2018 Saiga
2019/0217641 A1 7/2019 Nakamura

FOREIGN PATENT DOCUMENTS

JP 2006-181817 7/2006
JP 2006-231737 9/2006
JP 2010-131766 6/2010
JP 2013-188894 9/2013
JP 2013-233792 11/2013

* cited by examiner

*Primary Examiner* — Juanita D Jackson
(74) *Attorney, Agent, or Firm* — Duft & Bornsen, PC

(57) ABSTRACT

A guide device includes a guide configured to movably hold and guide a moving-object, and a stay to which the guide is attached. The stay includes an attachment portion including an attachment surface to which the guide is attached, a facing portion facing the attachment portion, and an adjuster configured to change a distance between the attachment portion and the facing portion to partially displace the attachment surface. The adjuster includes an adjustment plate arranged between the attachment portion and the facing portion, and a push member configured to push the adjustment plate to move the attachment portion of the stay.

10 Claims, 12 Drawing Sheets

GUIDE DEVICE AND PRINTER

CROSS-REFERENCE TO RELATED APPLICATIONS

This patent application is based on and claims priority pursuant to 35 U.S.C. § 119(a) to Japanese Patent Application No. 2018-248132, filed on Dec. 28, 2018, and Japanese Patent Application No. 2019-090538, filed on May 13, 2019, in the Japan Patent Office, the entire disclosure of each of which is hereby incorporated by reference herein.

BACKGROUND

Technical Field

The present invention relates to a guide device and a printer.

Related Art

As a device that reciprocally movably guides a moving-object such as a carriage on which a liquid discharge head is mounted, there is a guide attached to a stay, for example. The guide movably holds the carriage. The stay is arranged along a moving direction of the carriage.

SUMMARY

In an aspect of this disclosure, a guide device is provided that includes a guide configured to movably hold and guide a moving-object, and a stay to which the guide is attached. The stay includes an attachment portion including an attachment surface to which the guide is attached, a facing portion facing the attachment portion, and an adjuster configured to change a distance between the attachment portion and the facing portion to partially displace the attachment surface. The adjuster includes an adjustment plate arranged between the attachment portion and the facing portion, and a push member configured to push the adjustment plate to move the attachment portion of the stay.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
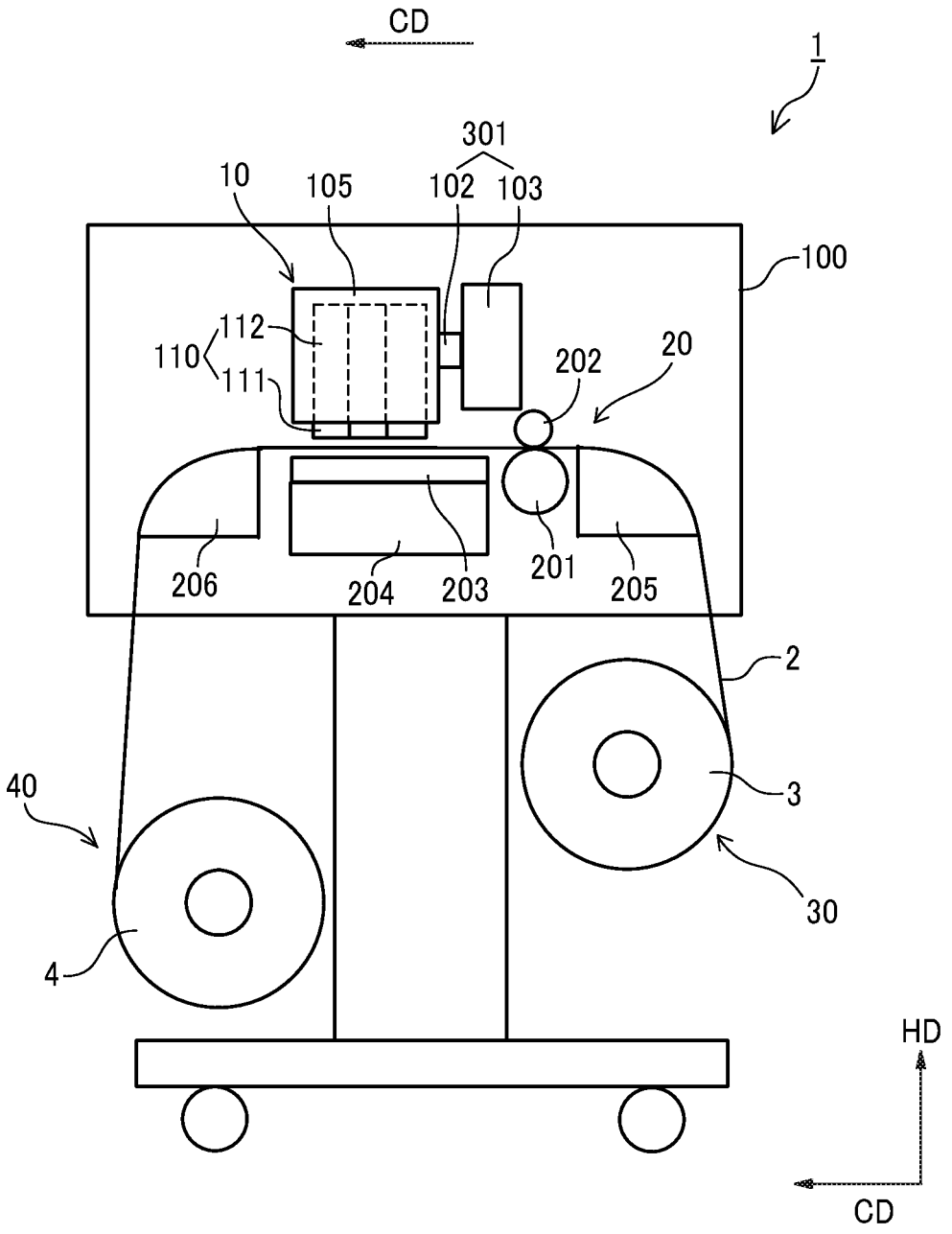
FIG. 1 is a side view of an example of a mechanism of a printer according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise.

Figure 2:
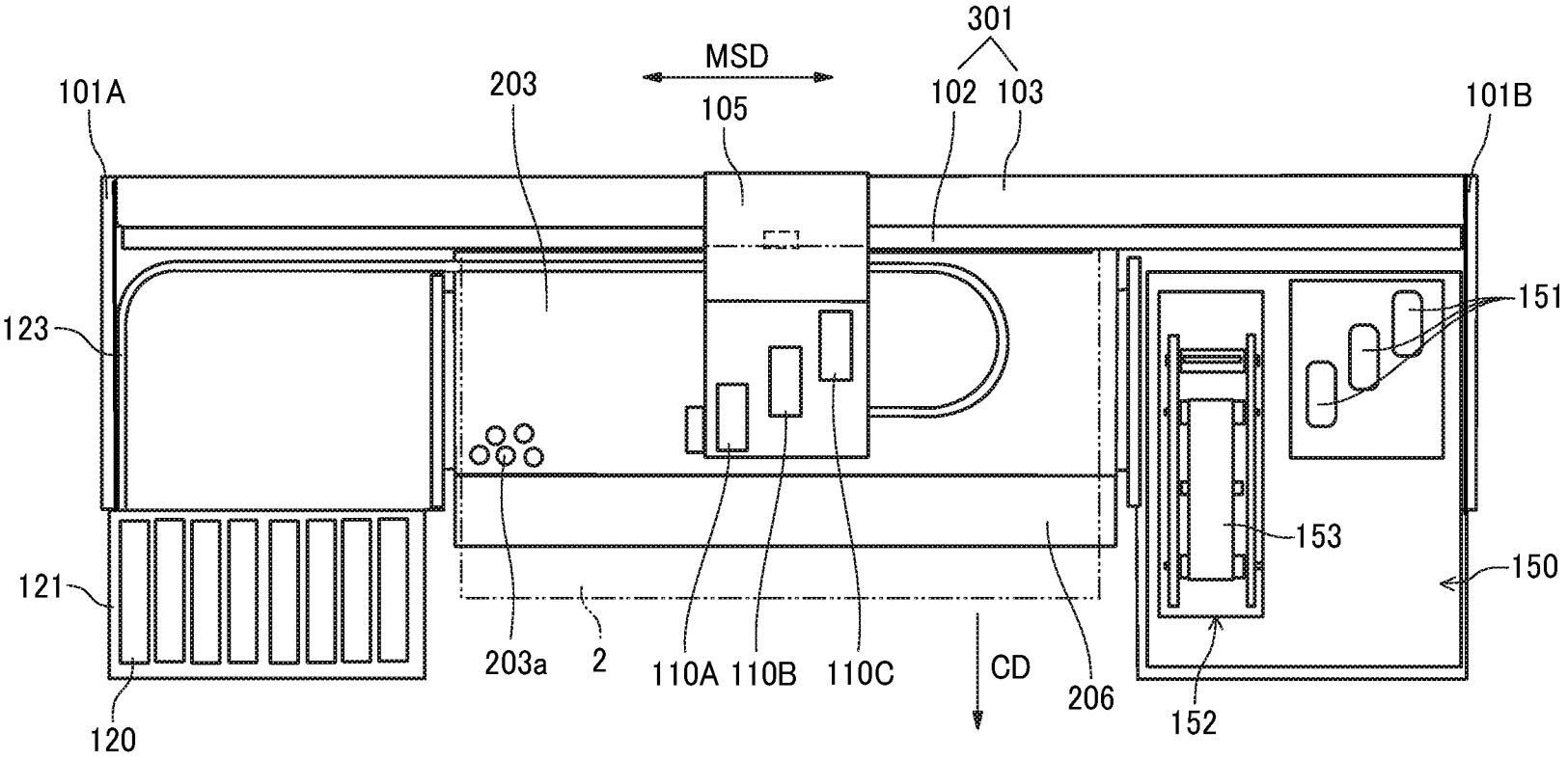
FIG. 2 is a plan view of the printer of FIG. 1.
Figure 3:
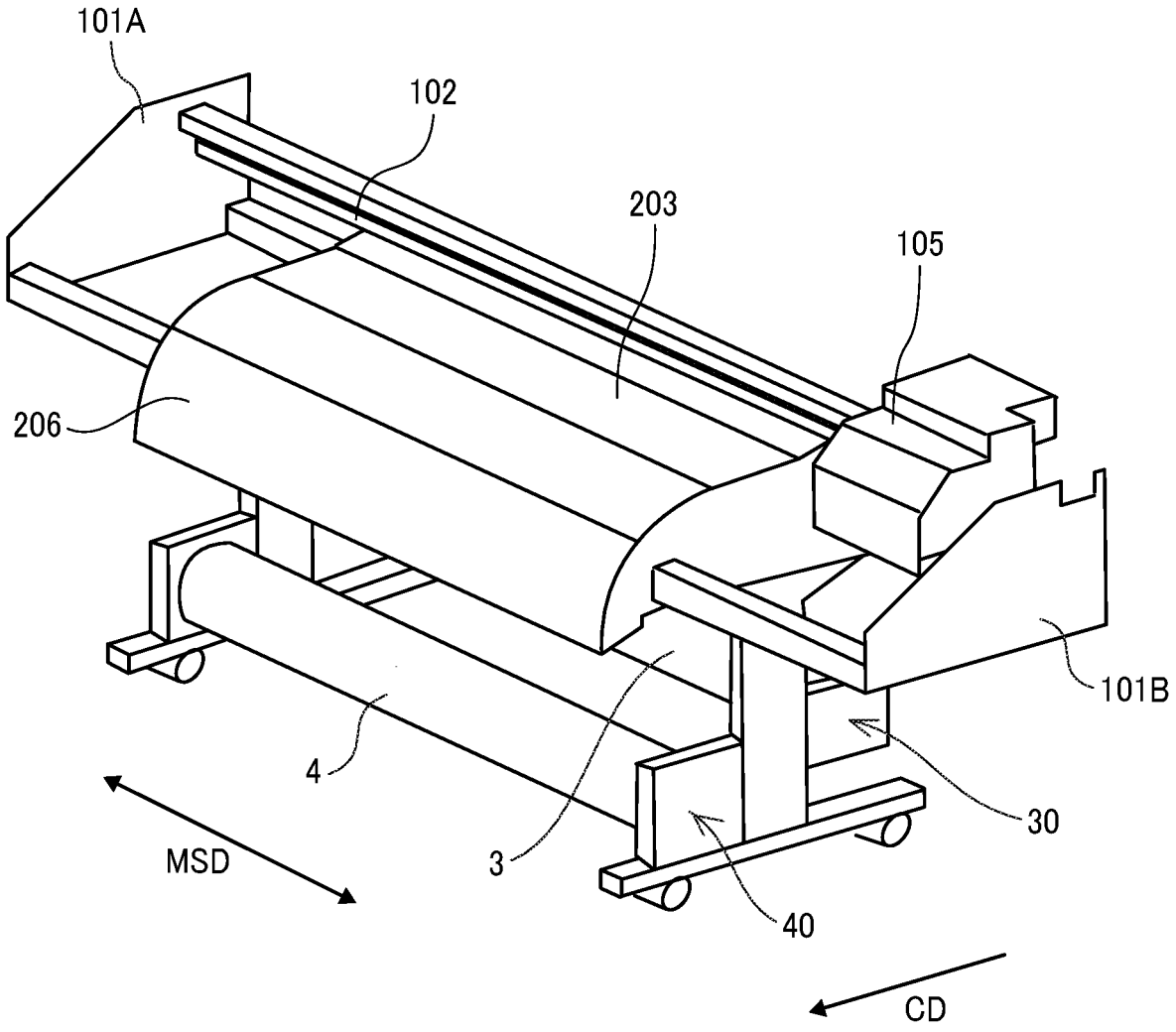
FIG. 3 is a schematic perspective view of a portion of the printer in the present embodiment.
Figure 4:
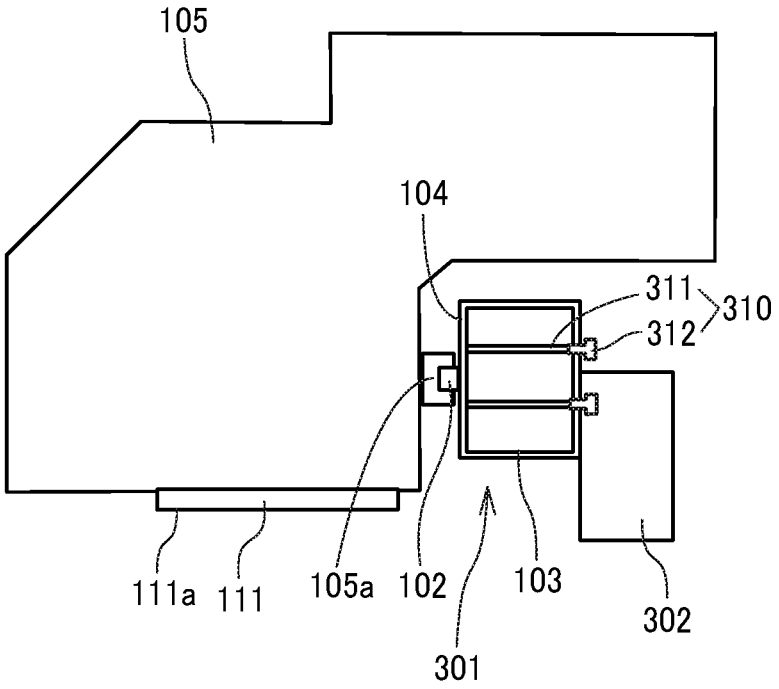
FIG. 4 is a side view of a carriage portion of the printer of FIG. 1.

Referring now to the drawings, wherein like reference numerals designate identical or corresponding parts throughout the several views, embodiments of the present disclosure are described below. First, a printer 1 according to an embodiment of the present disclosure is described with reference to FIGS. 1 to 4. FIG. 1 is a cross-sectional side view of the printer 1 according to the present embodiment. FIG. 2 is a plan view of the printer 1 of FIG. 1. FIG. 3 is a perspective view of a main part of the printer 1. FIG. 4 is a schematic side view of a carriage part.

The printer 1 is a serial-type inkjet recording apparatus as a liquid discharge apparatus. The printer 1 includes a printing unit 10 and a conveyor 20 in an apparatus body 100. The printing unit prints on a sheet 2 such as a roll paper (rolled sheet). The conveyor 20 conveys the sheet 2. Further, the printer 1 includes a roll feeder 30 and a roll winder 40 outside the apparatus body 100. The roll feeder 30 accommodates a feeding roll 3 in which the sheet 2 is wound in a roll shape and feeds the sheet 2 to the printing unit 10. The roll winder 40 accommodates a winding roll 4 onto which an image is printed by the printing unit 10. The sheet 2 is wound in a roll shape in the winding roll 4.

The printing unit 10 includes a guide 102 that holds and guides the carriage 105 so that the carriage 105 is reciprocally movable in a main scanning direction indicated by arrow "MSD" in FIG. 2. The guide 102 is attached to a stay 103 that is bridged between a left-side plate 101A and right-side plate 101B. The carriage 105 is an example of a moving-object.

Three liquid discharge devices 110 (110A to 110C) are mounted on the carriage 105. The liquid discharge device 110 includes a liquid discharge head 111 as a liquid discharge device and a sub tank 112 that supplies liquid to the liquid discharge head 111. Hereinafter, the "liquid discharge head" is simply referred to as the "head". The liquid discharge device 110 includes the head 111 and the sub tank 112 formed as a single body.

The printer 1 includes a cartridge holder 121 to which a plurality of main tanks 120 (liquid cartridges) containing liquids of respective colors are replaceably mounted on one end of the apparatus body 100. The cartridge holder 121 includes a liquid feed pump, etc., to supply liquid of the respective colors from the main tanks 120, mounted on the cartridge holder 121 to the heads 111 of the liquid discharge devices 110 via supply channels 123. The supply channels 123 is configured by supply tubes of respective colors.

The conveyor 20 includes a conveyance roller 201 and a counter roller 202 as a conveyor on an upstream side of the printing unit 10 in a conveyance direction of the sheet 2. The conveyance direction of the sheet 2 is indicated by arrow "CD" in FIG. 2, and is also referred to as a "sub-scanning direction". The conveyor 20 sandwiches the sheet 2 between the conveyance roller 201 and the counter roller 202 to convey the sheet to the printing unit 10.

The conveyor 20 includes a platen 203 and a suction mechanism 204 (see FIG. 2). The platen 203 faces the head 111 to guide a sheet 2. The suction mechanism 204 attracts the sheet 2 through suction holes 203*a* of the platen 203. Although only a portion of the suction holes 203*a* is illustrated in FIG. 2, the platen 203 includes suction holes 203*a* formed all over an entire surface of the platen 203.

The conveyor 20 includes a conveyance guide 205 on an entrance side (right-side in FIG. 1) of the conveyor 20. The conveyance guide 205 guides, to the printing unit 10, the sheet 2 fed from the feeding roll 3. The conveyor 20 further includes a conveyance guide 206 on an exit side (left-side in FIG. 1) of the conveyor 20. The conveyance guide 206 guides, to the winding roll 4, the sheet 2 on which an image is printed by the printing unit 10.

The printer 1 includes a maintenance mechanism 150 to maintain and recover a discharge function the head 111. The maintenance mechanism 150 is disposed on one side (right-side in FIGS. 2 and 3) of the printer 1 in the main scanning direction MSD of the carriage 105.

The maintenance mechanism 150 includes, for example, a wiping unit 152 including a cap 151 to cap a nozzle surface of the head 111 and a web 153 to wipe the nozzle surface of the head 111.

The printer 1 conveys the sheet 2 along the platen 203 in a conveyance direction CD (sub-scanning direction) by the conveyance roller 201 and the counter roller 202 while attracting the sheet 2 onto the platen 203.

The head 111 is driven in response to print signals while the carriage 105 moves in the main scanning direction MSD, to discharge the liquid of a desired color to the sheet 2 stopped, thus printing one line of an image on the sheet 2. Then, the sheet 2 is fed by a predetermined distance to print next line of the image. The above-described operations of feeding and printing are repeated to form a desired image on the sheet 2, and then the sheet 2 is ejected to the winding roll 4.

Figure 5:
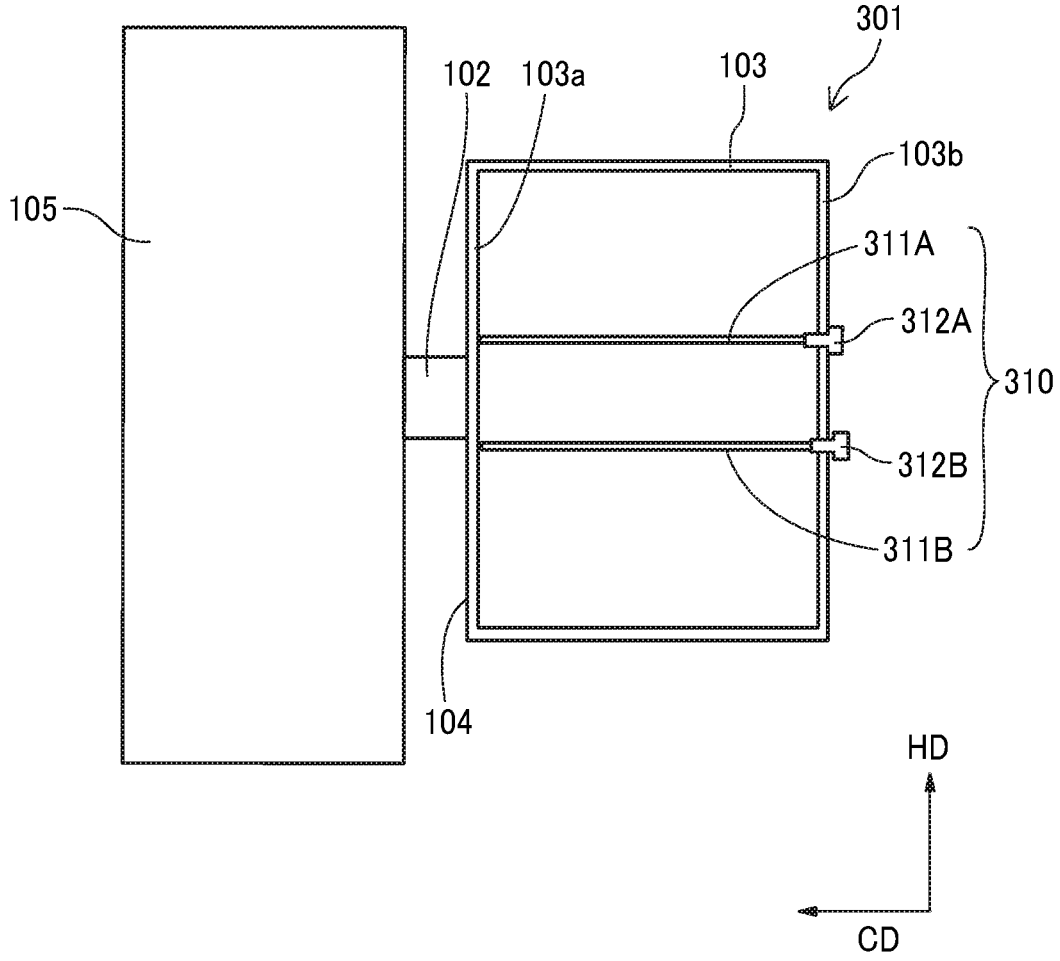
FIG. 5 is a schematic side view of a part of a guide device to guide a moving-object in a first embodiment of the present disclosure.

Next, a first embodiment of the present disclosure is described with reference to FIG. 5. FIG. 5 is an enlarged side view of a part of a device to guide a moving-object illustrating an embodiment of the present disclosure.

A guide device 301 includes the guide 102 and the stay 103 (see FIG. 1). The guide device 301 guides the carriage 105 so that the carriage 105 is reciprocally movable in the main scanning direction MSD. The guide 102 is a linear guide that reciprocally movably holds and guides the carriage 105. The guide 102 is attached to the stay 103. The stay 103 is a hollow square tube having a rectangular cross-section.

As illustrated in FIG. 4, the carriage 105 has a fitting portion 105*a* on a back side of the carriage 105 and is movably fitted to the guide 102. The stay 103 includes an attachment portion 103*a* that forms an attachment surface 104 to which the guide 102 is attached and a facing portion 103*b* that faces the attachment portion 103*a*. Both ends of the stay 103 in the main scanning direction MSD are fixed to the left-side plate 101A and the right-side plate 101B (see FIGS. 2 and 3) by a holder 302 as illustrated in FIGS. 3 and 4.

The guide device 301 includes an adjuster 310 that changes a distance between the attachment portion 103*a* and the facing portion 103*b* to partially displace the attachment surface 104. The attachment portion 103*a* includes the attachment surface 104 of the stay 103.

The adjuster 310 includes adjustment plates 311A and 311B between the attachment portion 103*a* and the facing portion 103*b*. The adjuster 310 further includes adjustment screws 312A and 312B on the facing portion 103*b* side. The adjustment screws 312A and 312B are advance and retract members to move the adjustment plate 311 toward and away from the attachment portion 103*a*.

The adjustment screws 312A and 312B may be push members contacting the adjustment plate 311 to push the adjustment plate 311 to move the adjustment plate 311 toward the attachment portion 103*a*. The adjustment screws 312A and 312B may also be pull members engaging the adjustment plate 311 and pull the adjustment plate 311 to move the adjustment plate 311 toward the facing portion 103*b*.

The adjustment plate 311A is disposed above the guide 102 in a height direction, and the adjustment plate 311B is disposed below the guide 102 in the height direction. The height direction is indicated by arrow "HD" in FIG. 5.

Figure 6:
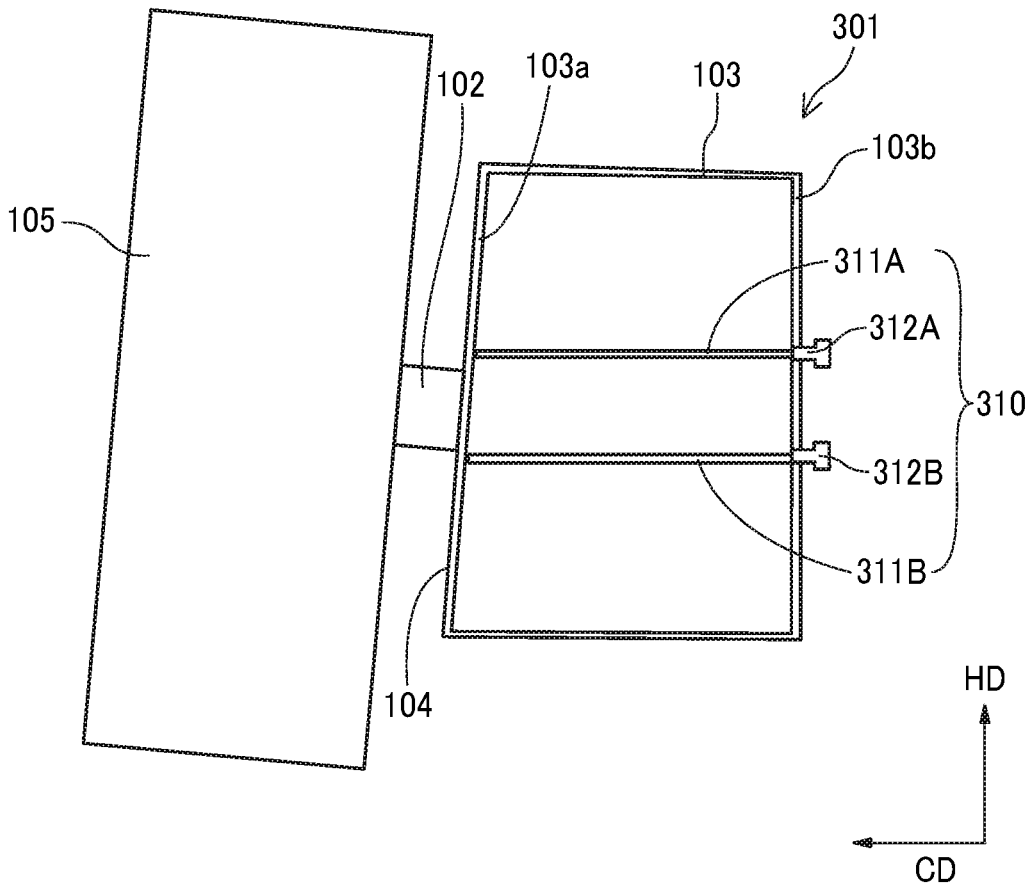
FIG. 6 is a schematic side view of the guide device and the carriage in a state before adjustment of the adjuster according to the first embodiment of the present disclosure.
Figure 7:
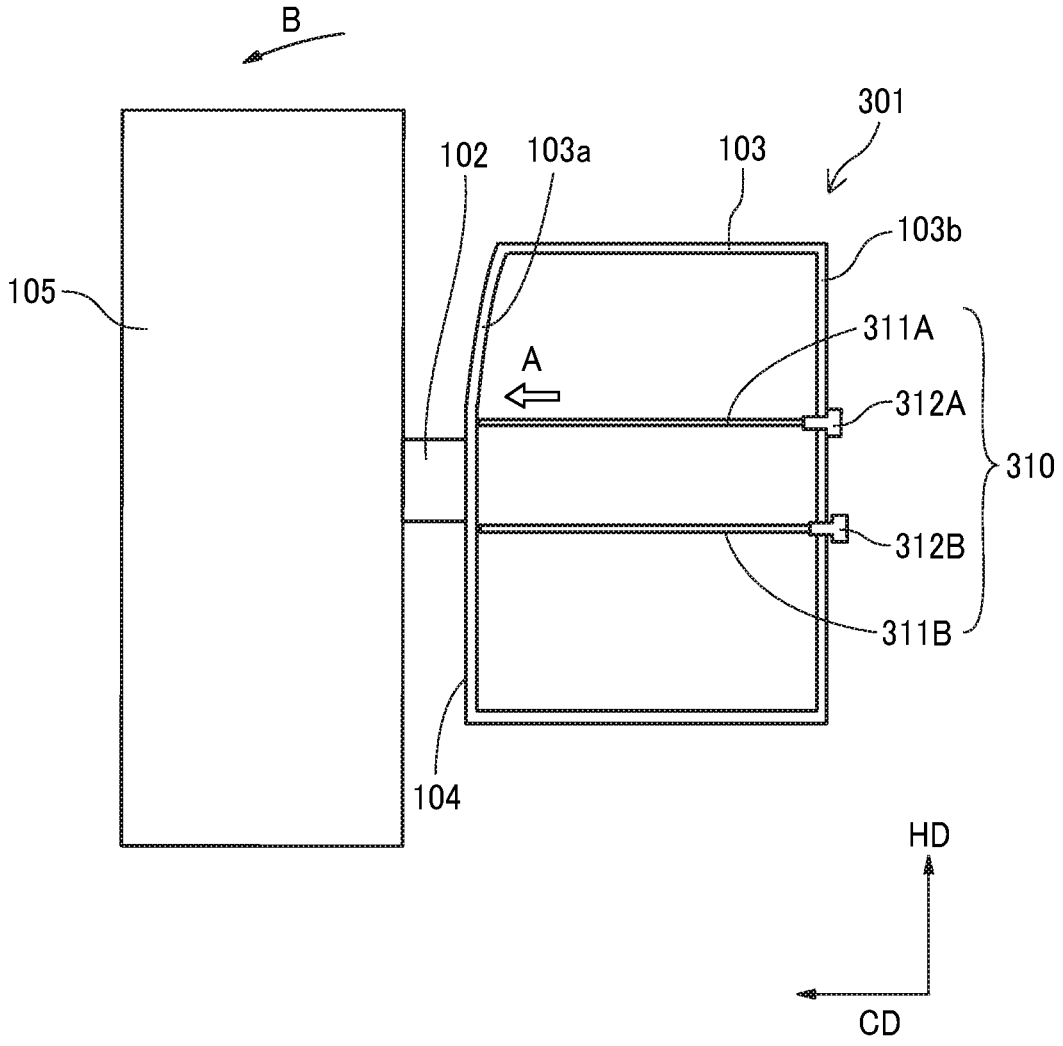
FIG. 7 is a schematic side view of the guide device and the carriage in a state after adjustment of the adjuster according to the first embodiment of the present disclosure.

Next, an effect of the present embodiment is illustrated with reference to FIGS. 6 and 7. FIG. 6 is a schematic side view of the guide device 301 and the carriage 105 in a state before adjustment of the adjuster 310. FIG. 7 is a schematic side view of the guide device 301 and the carriage 105 in a state after adjustment of the adjuster 310.

For example, as illustrated in FIG. 6, when an upper side of the attachment surface 104 of the stay 103 is tilted toward an upstream side in the conveyance direction CD (sub-scanning direction), and a lower side of the attachment surface 104 of the stay 103 is tilted toward a downstream side in the conveyance direction, the guide 102 is also tilted in the same direction with a direction of tilt of the attachment surface 104.

When the guide 102 is tilted, the carriage 105 is rotated and inclined in a plane orthogonal to the main scanning direction MSD in a configuration in which the carriage 105 is held only by one guide 102. When the carriage 105 is tilted, a gap between a nozzle surface 111*a* (see FIG. 4) of the head 111 and the sheet 2 conveyed by the conveyor 20 becomes nonuniform in the conveyance direction CD (sub-scanning direction). Thus, image quality of the image printed on the sheet 2 by the printer 1 may be degraded.

Thus, as illustrated in FIG. 7, an upper side of the adjustment screw 312A is operated to move (push out) an upper side of the adjustment plate 311A toward the attachment portion 103*a*, that is, in a direction indicated by arrow "A". Thus, a tip of the adjustment plate 311A pushes the attachment portion 103*a* toward the carriage 105 in a left direction in FIG. 7, and an upper part the attachment portion 103*a* also deforms toward the carriage 105 in the left direction in FIG. 7. Thus, an upper side of the guide 102 protrudes downstream in the conveyance direction CD (sub-scanning direction), and a posture of a lower part of the attachment surface 104 to which the guide 102 is attached is corrected to a vertical direction.

The posture of the lower part of the attachment surface 104 to which the guide 102 is attached is corrected vertically so that a tilt of the guide 102 is also corrected to vertical. Thus, the carriage 105 is rotated in a direction indicated by arrow "B" as illustrated in FIG. 7 (rotate in a counterclockwise direction), and an inclination (tilt) of the carriage 105 is thus corrected.

Since the adjustment plate 311A pushes the attachment portion 103*a* toward the carriage 105 to deform the attachment portion 103*a* toward the carriage 105, the adjustment plate 311A can linearly and stably push the attachment portion 103*a* of the stay 103. Thus, the guide device 301 can stably and accurately correct the inclination (tilt) of the carriage.

As a result, the nozzle surface 111*a* of the head 111 becomes substantially parallel to the platen 203 of the conveyor 20. Further, a gap between the nozzle surface 111*a* and the sheet 2 conveyed by the conveyor 20 is kept substantially constant in the conveyance direction CD (sub-scanning direction). Thus, the guide device 301 can prevent reduction in image quality due to nonuniformity of the gap.

FIGS. 6 and 7 illustrate an example in which the upper side of the adjustment plate 311A is moved to adjust the tilt of the guide 102 and to adjust the inclination of the carriage 105. Conversely, moving the lower side of the adjustment plate 311B toward the attachment portion 103*a* can rotate the carriage 105 in a direction opposite to the arrow B in FIG. 7 (rotate in a clockwise direction).

A second embodiment of the present disclosure is described with reference to FIG. 8. FIGS. 8A and 8B are schematic plan views of the guide device 301 to guide a moving-object (carriage 105) according to the present embodiment.

In the present embodiment, the adjuster 310 includes a plurality of adjustment plates 311 between the attachment portion 103*a* and the facing portion 103*b* of the stay 103. The plurality of adjustment plates 311 are separately arranged in the main scanning direction MSD, that is a longitudinal direction of the guide 102 and a moving direction of the moving-object (carriage 105).

Specifically, the plurality of adjustment plates 311 are arranged in series along the main scanning direction MSD, that is the moving direction of the moving-object (carriage 105).

A plurality (four in FIGS. 8A and 8B) of adjustment screws 312 are arranged in the main scanning direction MSD for each adjustment plates 311 on the facing portion 103*b* side of each adjustment plates 311.

Figure 8A:
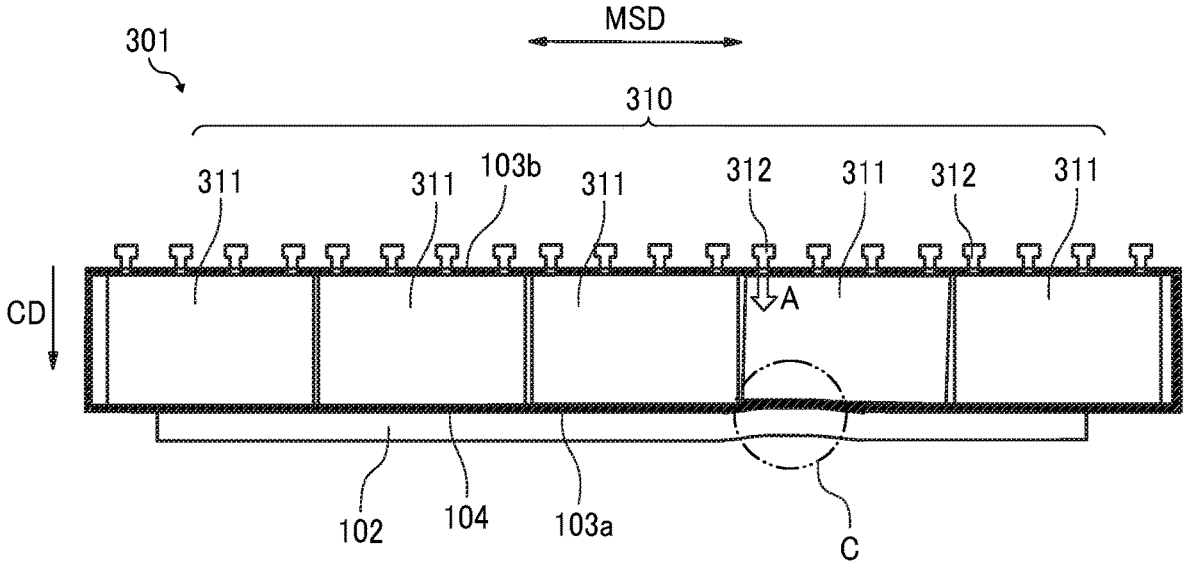
FIGS. 8A and 8B are schematic plan views of the guide device to guide a moving-object (carriage) according to a second embodiment of the present disclosure.

In an example as illustrated in FIG. 8A, a recess C is formed in a portion of guide 102. The recessed part C bents (concaves) toward the facing portion 103*b*. The guide device 301 thus configured operates one or more adjustment screws 312 to move the adjustment plate 311 corresponding to the attachment surface 104 at which the recess C is formed. Then, the adjustment plate 311 is moved in a direction indicated by arrow A (see FIG. 8A) toward the attachment portion 103*a*.

Figure 8B:
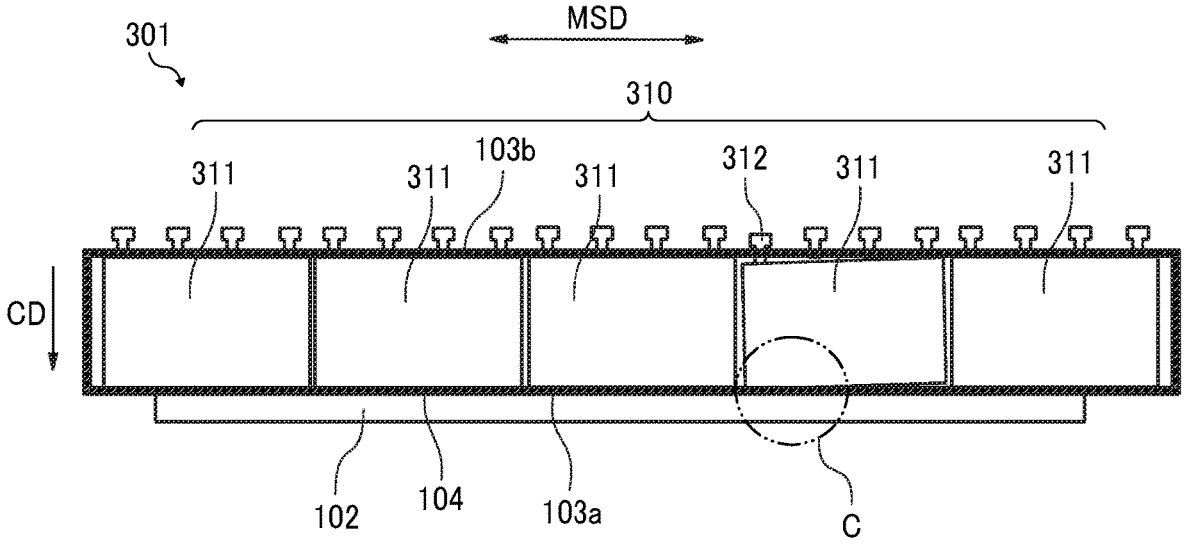

As a result, as illustrated in FIG. 8B, the recess C is pushed out so that the guide 102 is straighten. Thus, the guide device 301 can reduce a straightness of the guide 102. Here, the straightness of the guide 102 is an amount of deviation of a surface of the guide 102 from a geometrically correct straight line.

In the above-described case, the straightness of the guide 102 can be adjusted to be smaller as a width of the adjustment plate 311 in the main scanning direction MSD becomes smaller, or as a number of the adjustment screws 312 of the adjustment plate 311 is larger.

Further, the straightness of the guide 102 affects the durability of the guide 102, and the straightness of the guide 102 thus has to be adjusted with high accuracy. However, the tilt of the carriage 105 do not have to be adjusted with high accuracy outside a print area. Therefore, as in the present embodiment, the adjustment plate 311 is divided into a plurality of parts. Thus, the guide device 301 do not have to adjust a tilt (inclination) of the carriage 105 outside the print area, and thus can reduce a number of adjustment steps.

Figure 9:
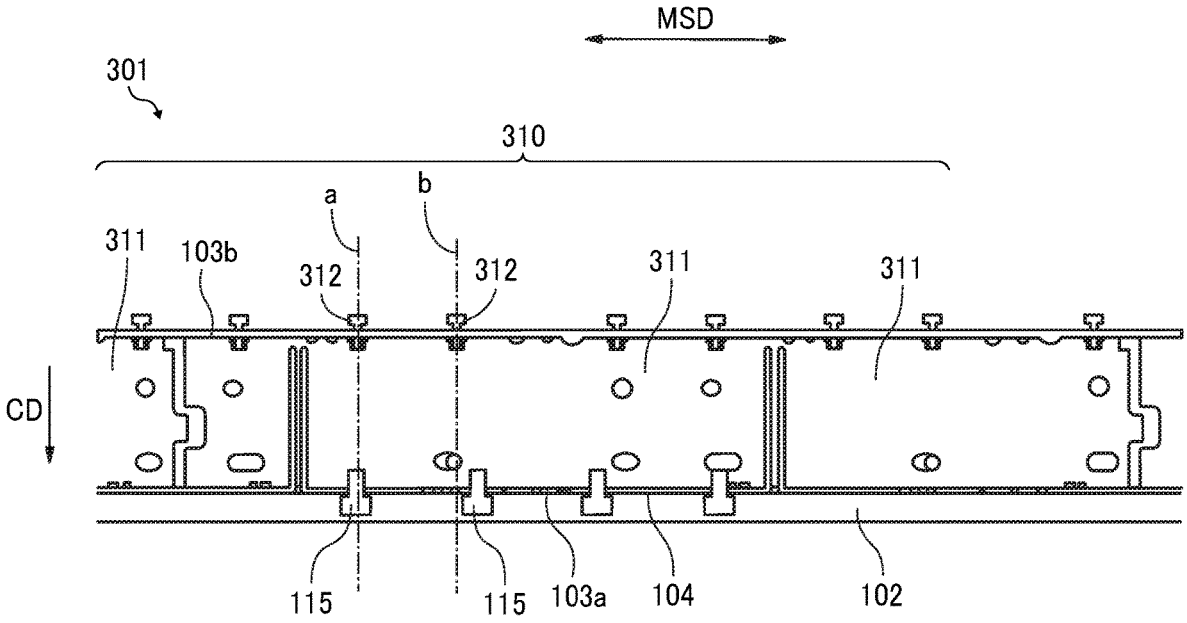
FIG. 9 is a schematic plan view of the guide device to guide a moving-object (carriage) according to a third embodiment of the present disclosure.

A third embodiment of the present disclosure is described with reference to FIG. 9. FIG. 9 is a schematic plan view of the guide device 301 to guide a moving-object (carriage 105) according to the third embodiment.

Also in the present embodiment, the adjuster 310 includes a plurality of adjustment plates 311 divided into a plurality of parts and arranged along the main scanning direction MSD (a longitudinal direction of the guide 102 or a moving direction of the moving-object) as similarly with the second embodiment. The plurality of adjustment plates 311 is arranged between the attachment portion 103*a* and the facing portion 103*b* of the stay 103.

A plurality (four in FIGS. 8A and 8B) of adjustment screws 312 are arranged in the main scanning direction MSD for each adjustment plates 311 on the facing portion 103*b* side of each adjustment plates 311. The guide 102 is fixed to the attachment surface 104 of the stay 103 with screws 115 as a fixing member.

Therefore, the adjustment screw 312 is arranged in the same position as a position of the screw 115 in the main scanning direction MSD as indicated by a line "a" in FIG. 9. Alternatively, the adjustment screw 312 may be arranged in the vicinity of the screw 115 in the main scanning direction MSD as indicated by a line "b" in FIG. 9.

Since the guide 102 is connected (fixed) to the stay 103 with screws 115, the guide device 301 can push a portion of the guide 102 that is likely to be deformed by a deformation of the stay 103 with the adjustment plate 311 and thus can effectively adjust the straightness of the guide 102.

Figure 10:
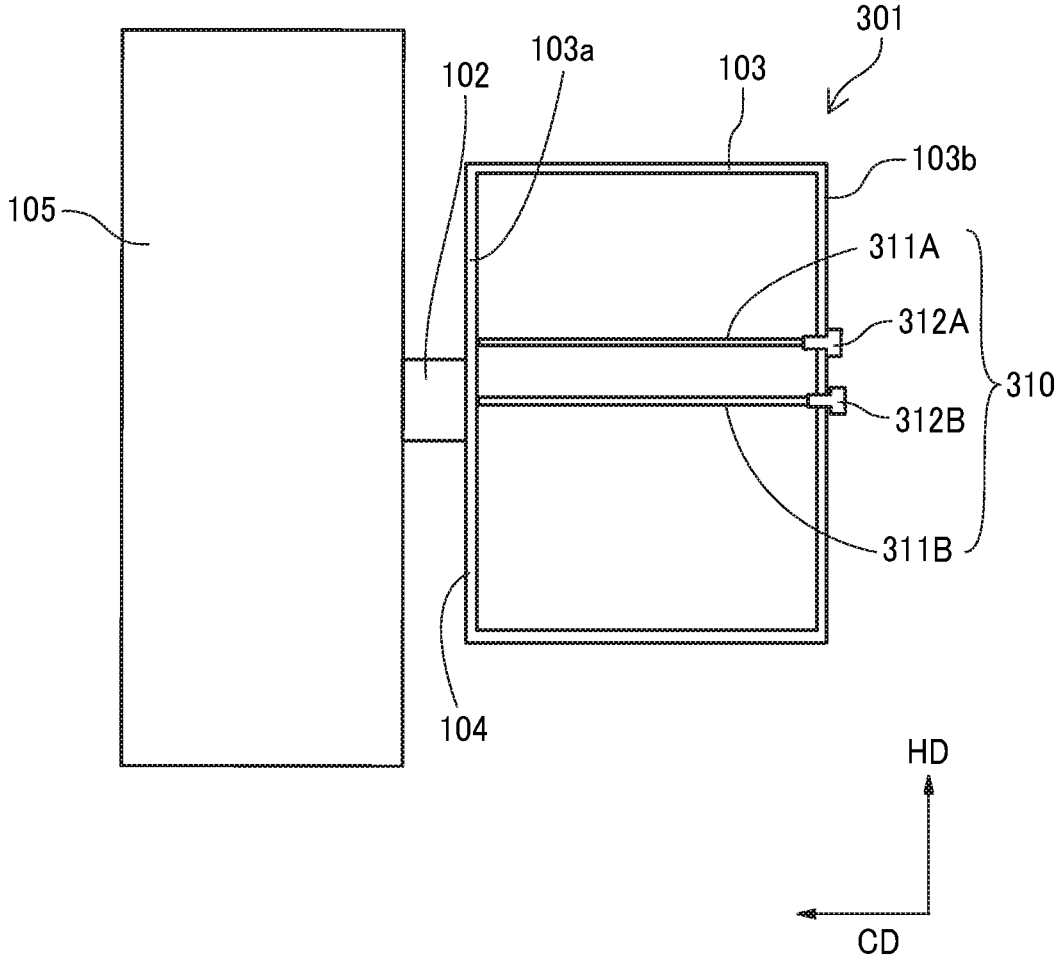
FIG. 10 is a schematic side view of a part of a guide device to guide a moving-object (carriage) according to a third embodiment of the present disclosure.

A fourth embodiment of the present disclosure is described with reference to FIG. 10. FIG. 10 is a schematic side view of a part of a guide device 301 to guide a moving-object (carriage 105) in the fourth embodiment.

In the present embodiment, an adjustment plate 311A disposed above the guide 102 is used a device to adjust the tilt (inclination) of the guide 102. Further, an adjustment plate 311B disposed on a back surface of the guide 102 (a surface opposite to the guide 102 via the attachment portion 103*a*) is used as a device to adjust the straightness of the guide 102.

Thus, a plurality of adjustment plates 311A and 311B are divided into an inclination-adjustment part (adjustment plate 311A) and a straightness-adjustment part (adjustment plate 311B). Thus, the guide device 301 can adjust the guide 102 in a shorter time.

Figure 11:
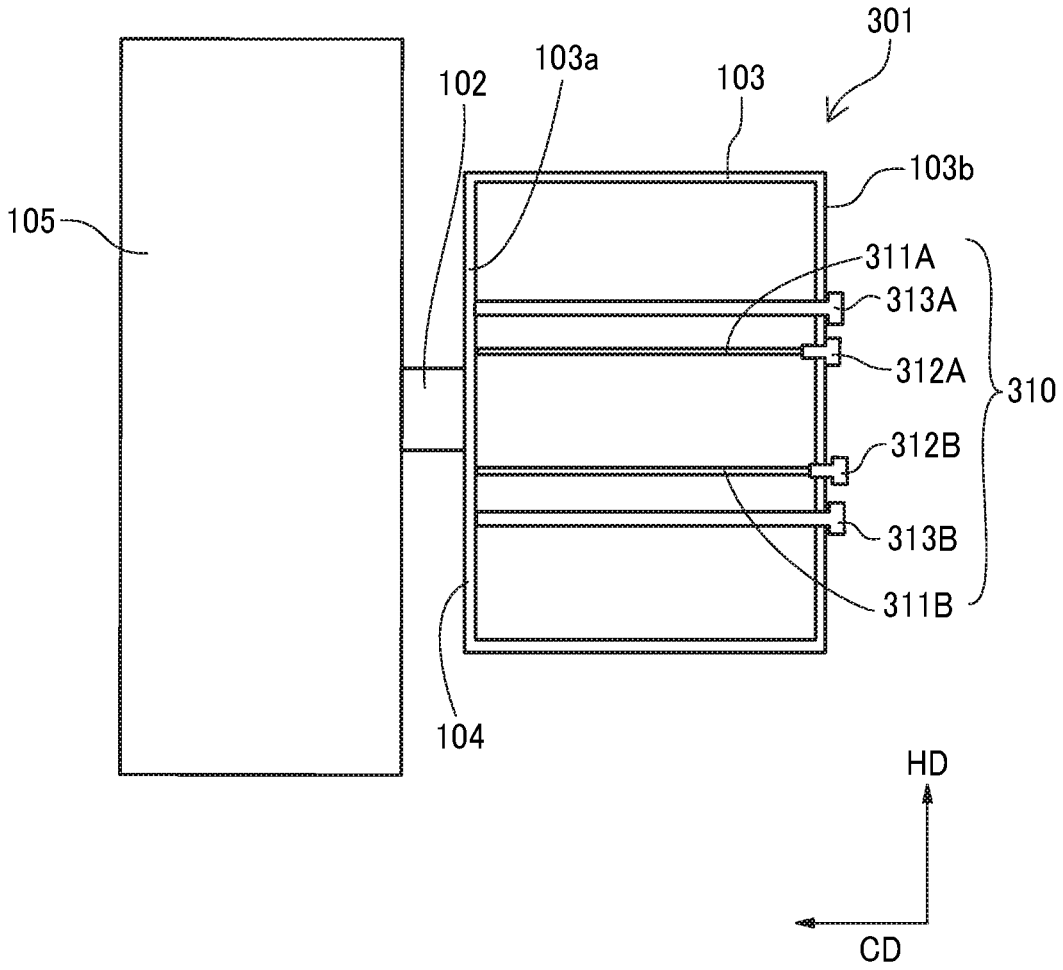
FIG. 11 is a schematic side view of a part of a guide device to guide a moving-object (carriage) according to a fifth embodiment of the present disclosure.

A fifth embodiment of the present disclosure is described with reference to FIG. 11. FIG. 11 is a schematic side view of a part of a guide device 301 to guide a moving-object (carriage 105) in the fifth embodiment.

In addition to the configuration of the first embodiment, the guide device 301 according to the present embodiment includes pull-adjustment screws 313 (313A and 313B) that are pull members to pull the attachment portion 103*a* of the stay 103 toward the facing portion 103*b*.

Thus, the guide device 301 can not only push the attachment portion 103*a* of the stay 103 against the facing portion 103*b*, but can also pull the attachment portion 103*a* of the stay 103. Thus, the guide device 301 can increase an adjustment range of the attachment surface 104, and can easily adjust the inclination and straightness of the guide 102.

Further, the guide device 301 including a push member (adjustment screws 312) separated from a pull member (pull-adjustment screws 313) can precisely adjust the guide 102 compared to the guide device 301 that use only one member to push and pull the attachment portion 103*a*. For example, if one member is used to push and pull the adjustment plate 311, the adjustment plate 311 has to be connected to the adjustment screws 312 (push member) and the pull-adjustment screws 313 (pull member).

Thus, it becomes difficult to set different moving amounts for each ends of the adjustment plate 311 (for each ends of the adjustment plate 311 in the longitudinal direction of the guide 102). In the above-described case, the adjustment plate 311 and the adjustment screws 312 may be connected with a flexible joint to solve the above-described problem. However, the configuration of the guide device 301 becomes complicated.

Figure 12:
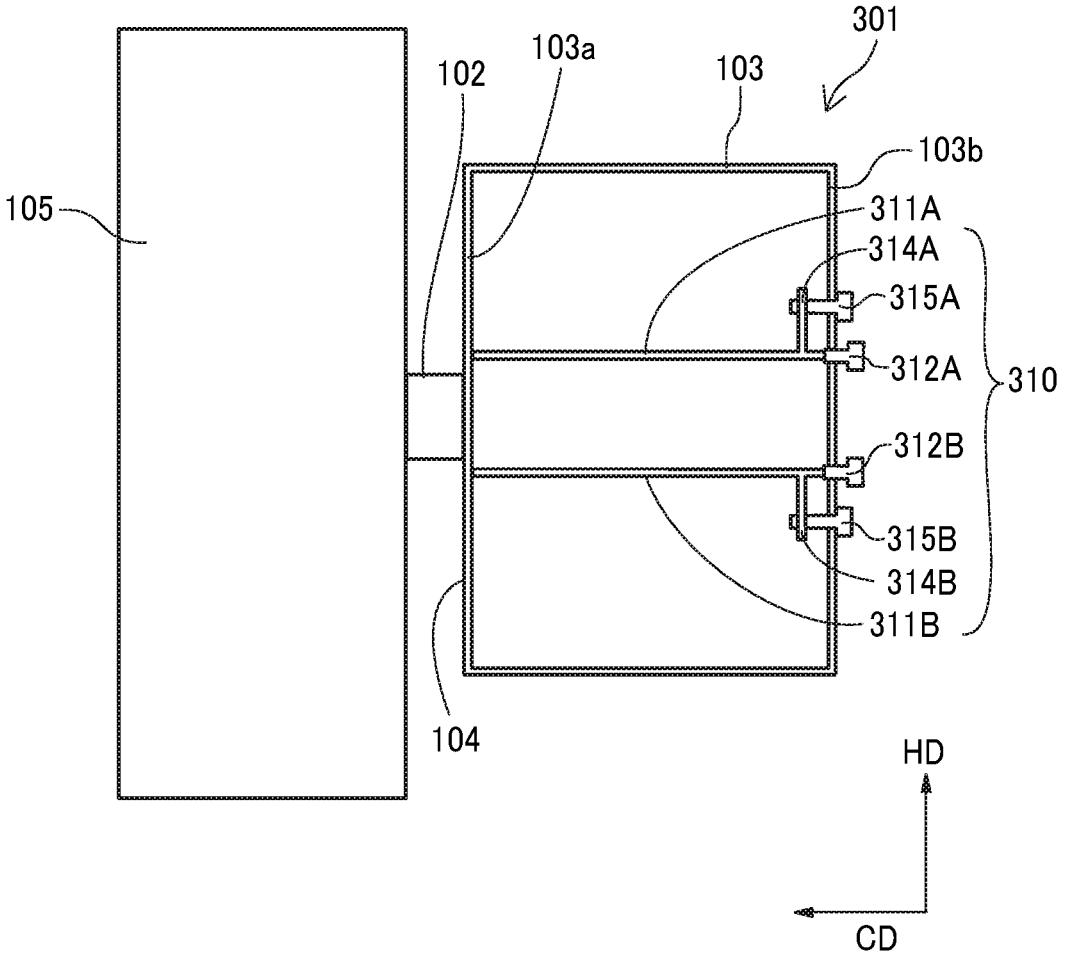
FIG. 12 is a schematic side view of a part of a guide device to guide a moving-object (carriage) according to a sixth embodiment of the present disclosure.

A sixth embodiment of the present disclosure is described with reference to FIG. 12. FIG. 12 is a schematic side view of a part of a guide device 301 to guide a moving-object (carriage 105) in the sixth embodiment.

In the present embodiment, a leading end (one end) of the adjustment plate 311 is fixed to the attachment portion 103*a* of the stay 103.

Similarly to the first embodiment, the guide device 301 includes adjustment screws 312 (312A and 312B) on the facing portion 103*b*. The adjustment screws 312 move the adjustment plate 311 toward the attachment portion 103*a*.

In the present embodiment, the guide device 301 includes connectors 314 (314A and 314B) connected to a surface of the adjustment plate 311 to form a single body with the adjustment plate 311. Further, the guide device 301 includes pull-adjustment screws 315 (315A and 315B) connected to the connectors 314. The pull-adjustment screws 315 configure a pull member together with the adjustment plate 311.

With the configuration including the connectors 314, an operation of the pull-adjustment screw 315 can pull the adjustment plate 311 toward the facing portion 103*b*. Thus, the attachment portion 103*a* fixed to the adjustment plate 311 moves toward the facing portion 103*b*.

Thus, the connectors (314) connecting one end (facing portion 103*b* side) of the adjustment plate 311 and the pull member (pull-adjustment screw 315), and another end (attachment portion 103*a* side) of the adjustment plate 311 is fixed to the attachment portion 103*a* of the stay 103. The pull member (pull-adjustment screw 315) pulls the adjustment plate 311 toward the facing portion 103*b*.

Thus, the guide device 301 in the sixth embodiment can increase an adjustable range as in the fifth embodiment. Further, the guide device 301 in the sixth embodiment can shorten a length of the pull-adjustment screw 315 to be shorter than a length of the pull-adjustment screw 313 of the fifth embodiment (see FIG. 11).

In each of the above embodiments, the adjustment plates 311 are provided for each of the upper side and the lower side of the guide 102 in the height direction HD. However, one adjustment plate 311 may also be provided at least in any one of the upper side and the lower side of a guide 102.

In each of the above-described embodiments, the carriage 105, on which the head 111 of the printer 1 is mounted, is described as a moving-object. However, the moving-object is not limited to the carriage. For example, the present embodiments can also be similarly applied to a guide device to guide a reading unit of the image reading apparatus as a moving-object, or a guide device to guide a cutter that cuts a roll paper as the moving-object, and the like.

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. A guide device comprising:
a guide configured to movably hold and guide a moving-object; and
a stay to which the guide is attached,
wherein the stay includes:
an attachment portion including an attachment surface to which the guide is attached;
a facing portion facing the attachment portion; and
an adjuster configured to change a distance between the attachment portion and the facing portion to partially displace the attachment surface,
wherein the adjuster includes:
an adjustment plate arranged between the attachment portion and the facing portion; and
a push member configured to push the adjustment plate to move the attachment portion of the stay.

2. The guide device according to claim 1,
wherein the push member is disposed at the facing portion, and
the push member pushes the adjustment plate toward the attachment portion.

3. The guide device according to claim 2, further comprising a fixing member configured to fix the guide to the attachment surface of the stay,
wherein the push member is arranged in a vicinity of the fixing member in a moving direction of the moving-object.

4. The guide device according to claim 1, further comprising a plurality of adjustment plates including the adjustment plate,
wherein at least one of the plurality of adjustment plates is provided at each of an upper side and a lower side of the guide in a height direction of the guide device.

5. The guide device according to claim 1, further comprising a plurality of adjustment plates including the adjustment plate,
wherein the plurality of adjustment plates is arranged in series along a moving direction of the moving-object.

6. The guide device according to claim 1, further comprising a pull member configured to pull the attachment portion toward the facing portion.

7. The guide device according to claim 6, further comprising a connector connecting one end of the adjustment plate and the pull member, wherein another end of the adjustment plate is fixed to the attachment portion, and the pull member pulls the adjustment plate toward the facing portion.

8. The guide device according to claim 1, further comprising a plurality of adjustment plates including the adjustment plate, wherein one of the plurality of adjustment plate disposed above the guide adjusts a tilt of the guide, and another of the plurality of adjustment plate disposed on a back surface of the guide adjusts a straightness of the guide.

9. A printer comprising:

a liquid discharge head configured to discharge a liquid to form an image; and the guide device according to claim 1, wherein the moving-object is a carriage mounting the liquid discharge head, and the guide device guides the carriage to reciprocally move in a main scanning direction.

10. The printer according to claim 9, further comprising a plurality of adjustment plates including the adjustment plate, wherein at least one of the plurality of adjustment plates is provided at each of an upper side and a lower side of the guide in a height direction of the guide device, and the push member pushes the adjustment plate to rotate the carriage to adjust a tilt of the carriage.

* * * * *